United States Patent [19]

Levy et al.

[11] 4,101,321

[45] Jul. 18, 1978

[54] IMAGING SYSTEM

[75] Inventors: Mortimer Levy, Rochester; William L. Goffe, Webster, both of N.Y.

[73] Assignee: Xerox Corporation, Stamford, Conn.

[21] Appl. No.: 71,781

[22] Filed: Sep. 14, 1970

Related U.S. Application Data

[63] Continuation-in-part of Ser. No. 612,122, Jan. 27, 1967, abandoned.

[51] Int. Cl.[2] ..... G03G 5/04

[52] U.S. Cl. ..... 96/1.5 R; 96/27 R

[58] Field of Search ..... 96/1, 1.5–1.8, 96/1.1, 27; 117/17.5, 37 L, 37 LE, 201, 215

[56] References Cited

U.S. PATENT DOCUMENTS

| | | | |
|---|---|---|---|
| 2,911,299 | 11/1959 | Baril et al. | 96/49 |
| 3,238,041 | 3/1966 | Corrsin | 96/1.1 |
| 3,254,997 | 6/1966 | Schaffert | 96/1.1 |
| 3,286,025 | 11/1966 | Ingersoll | 178/6.6 TP |
| 3,291,601 | 12/1966 | Gaynor | 96/1.1 |
| 3,520,681 | 7/1970 | Goffe | 96/1 |
| 3,542,545 | 11/1970 | Goffe | 96/1.1 |
| 3,556,781 | 1/1971 | Levy et al. | 96/1 |
| 3,656,990 | 4/1972 | Goffe | 96/1 R |

*Primary Examiner*—Wm. A. Powell
*Assistant Examiner*—C. Van Horn
*Attorney, Agent, or Firm*—James J. Ralabate; John E. Beck; George J. Cannon

[57] ABSTRACT

An imaging system wherein an imaged migration-type imaging member is provided and either the background of image areas of said image are selectively reduced to a more transparent condition. The imaged member comprises a softenable layer containing agglomerable materials in both image and complementary background configurations. Such imaged members may be provided by migration imaging techniques described herein. This member is contacted with solvent vapors capable of softening the softenable layer and heated, thereby causing the agglomerable material to selectively agglomerate in one of either the background or image areas.

62 Claims, 7 Drawing Figures

IMAGING SYSTEM

CROSS-REFERENCE TO RELATED APPLICATIONS

This application is a continuation-in-part of copending U.S. Patent application Ser. No. 612,122, filed Jan. 27, 1967, now abandoned.

BACKGROUND OF THE INVENTION

This invention relates in general to imaging, and more specifically, to a novel migration imaging system.

There has been recently developed a migration imaging system capable of producing high quality images of high density, continuous tone, and high resolution. This system is described and claimed in application Ser. No. 403,002, filed Oct. 12, 1964, now abandoned, U.S. Pat. No. 3,520,681, and in copending applications Ser. No. 837,780, and Ser. No. 837,591, both filed June 30, 1969, now Pat. Nos. 3,975,195 and 4,013,462, respectively. In a typical embodiment of this imaging system, a migration imaging member comprising a substrate with a layer of softenable or soluble material, containing electrically photosensitive particles overlying the substrate is imaged in the following manner: An electrical latent image is formed on the electrically photosensitive surface, e.g., by uniform electrostatic charging and exposure to a pattern of activating electromagnetic radiation. The softenable layer is then developed by exposing the plate to a solvent which dissolves only the softenable layer. The photosensitive particles which have been exposed to radiation migrate through the softenable layer as it is softened and dissolved, leaving an image on the substrate conforming to a negative of the original. This is known as a positive to negative image. Through the use of various techniques, either positive to positive or positive to negative images may be made depending on the materials used, the charging polarities, and other imaging parameters. Those portions of the photosensitive material which do not migrate to the substrate may be washed away by the solvent with the softenable layer.

In general, three migration imaging members may be used: A layered configuration which comprises a substrate coated with a layer of softenable material, and an overcoating of electrically photosensitive material (usually particulate) contiguous the upper surface of the softenable layer; a binder structure in which the electrically photosensitive particles are dispersed throughout the softenable layer which overcoats a substrate; and an overcoated structure in which a substrate is overcoated with a layer of softenable material followed by an overcoating of electrically photosensitive particles and a second overcoating of softenable material which sandwiches the electrically photosensitive particles.

The migration imaging process comprises a combination of process steps which include charging, exposing and developing. The characteristics of these images are dependent on such process steps as charging potentials, exposure levels, and development techniques, as well as the particular combination of the various process steps. High density, continuous tone and high resolution are some of the photographic characteristics which are possible to achieve in this system. The image is characterized as a fixed or unfixed electrically photosensitive powder image which can be used in a number of applications such as microfilm, hard copy, optical masks, or stripout applications using adhesive materials. Alternative embodiments of the system are further described in the above cited copending applications.

In a related imaging system described in copending U.S. Patent application Ser. No. 483,675, filed Aug. 30, 1965, electrically photosensitively-inert particulate material is used to form images in the migration imaging system already defined above. In this system, a developable image is formed by charging in image configuration through the use of mask or stencil. This latent image is then developed, for example by contacting the member with a solvent for the softenable material.

In another recently developed imaging system, an image is formed by the selective disruption of a particulate material overlying an electrostatically deformable film or layer. The imaging structure used in this system is substantially the same as that used in the imaging system already described above, and involves exposing the charged member to an optical image to selectively relocate the charge and form a developable charge pattern. The softenable layer is then developed or softened by heat whereupon the fracturable or particulate layer is selectively disrupted resulting in a rearrangement of the particles to form an image viewable by reflected or transmitted light. When the structure is developed by heat, the electrically photosensitive area or layer is disrupted and the electrically photosensitive particles are thereby selectively rearranged to change the optical properties of the plate. The image is believed to be formed because the electrically photosensitive particles drift on top of one another and accumulate in valleys or pockets of the deformation image leaving the raised portions of the image uncovered. This imaging system is believed to be substantially due to a surface disruption effect with no substantial migration of the electrically photosensitive particles within the softenable layer. This final image differs from that of the migration imaging system described above, in that the softenable layer is deformed in conjunction with a disruption of the photosensitive particles. This system is described and claimed in application Ser. No. 520,423, filed on Jan. 13, 1966, now abandoned, U.S. Pat. No. 3,542,545.

Although each of the above imaging systems is capable of producing excellent images, there is a continuing need for more simplified systems which provide even higher quality images for example, new systems having high density images and low background.

SUMMARY OF THE INVENTION

It is, therefore, an object of this invention to provide a novel imaging system.

It is another object of this invention to provide a novel migration imaging system.

It is another object of this invention to provide a migration imaging system producing high density images.

It is another object of this invention to provide an imaging system capable of producing images with substantially zero background.

It is another object of this invention to provide a method for substantially reducing the amount of background in migration-type images.

It is yet another object of this invention to provide a high quality dry developed migration imaging system.

It is still another object of this invention to provide a rapid, dry developable imaging member or copy paper.

The foregoing objects and others are accomplished in accordance with this invention by providing an imaging system wherein an imaged migration-type imaging member is provided, and either the background areas or image areas of said image are selectively reduced to a more transparent condition, in many cases substantially to zero background, and the image contrast density is thereby greatly enhanced. For example, one embodiment of the inventive system comprises an imaging system in which an imaging member structure comprising a substrate overcoated with a layer of softenable material containing a fracturable layer of electrically photosensitive particles contiguous the surface of the softenable layer is imaged in the following manner: An electrical latent image is formed on the photosensitive surface, for example by uniformly electrostatically charging under dark room conditions, and exposing to a pattern of activating electromagentic radiation. The softenable layer is then developed by contacting for a few seconds with a solvent vapor while still being kept under dark room conditions, so as to cause a selective migration of electrically photosensitive particles in the areas exposed to radiation, down toward or near the substrate. It will be understood, that such an imaged migration-type member may be provided by any suitable means, many of which are described later herein. The vapor developed structure is then subjected to a heating step causing the photosensitive particles in the areas unexposed to radiation to agglomerate or flocculate, often accompanied by fusion of the photosensitive particles, which results in a very high contrast density, low background image following the application of this inventive two-step technique. Alternatively, the imaged migration-type image may be formed by heat development, followed by exposure to solvent vapors, and a second heating step which results in the reduction of the background.

The term "agglomerable" and its variant forms as used in the present specification and claims refers to any material capable of agglomerating, flocculating, or fusing with other particles or portions of the same material. Such agglomerable materials typically agglomerate or fuse to form particles of larger volume but of lesser cross-sectional areas than the corresponding volume in a greater number of particles, thereby effectively reducing the cross-sectional area of particulate material in areas of imaging members where such agglomeration has taken place.

As already described above, the final image in the present invention differs from the migration images formed by liquid solvent washaway development, in that in the present system the softenable layer remains substantially intact after development. This image is also distinguishable from that defined above in application Ser. No. 520,423, in which the image is formed by a surface disruption, in that here the image is formed by the selective migration of migration marking particles from the surface down toward or near the substrate followed by a reduction in background due to flocculation or agglomeration, and typically fusion of the marking particles in the non-image or background areas.

BRIEF DESCRIPTION OF THE DRAWINGS

For a better understanding of the invention as well as other objects and further features thereof reference is made to the following detailed disclosure of preferred embodiments of the invention taken in conjunction with the accompanying drawings thereof, wherein.

DESCRIPTION OF THE PREFERRED EMBODIMENTS

Figure 1A:
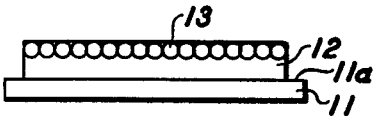
FIG. 1 is a partially schematic, cross-sectional view of a migration imaging member suitable for use in the present invention.
FIG. 1B is a partially schematic, cross-sectional view of another embodiment of the migration imaging member suitable for use in the present invention.
FIG. 1C is a partially schematic, cross-sectional view of another migration imaging member suitable for use in the present invention.

Referring now to FIG. 1A, there is shown a schematic drawing of a preferred embodiment of the migration imaging member suitable for use in this invention comprising supporting substrate 11, overcoated with a layer of softenable material 12 which contains contiguous its upper surface a fracturable layer of migration marking material 13.

Figure 1B:
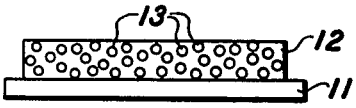

In FIG. 1B the migration imaging member comprises supporting substrate 11 having softenable material layer 12 coated thereon. However, in this configuration the migration marking material 13 is dispersed throughout softenable layer 12 in a binder structured configuration.

Figure 1C:
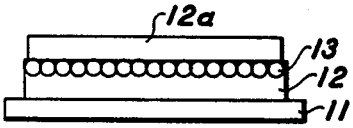

In FIG. 1C the migration imaging member comprises substrate 11, softenable material layer 12 and fracturable or particulate layer of migration marking material 13, and an additional overlayer of softenable material 12A.

Copending applications Ser. No. 837,780, filed June 30, 1969, now U.S. Pat. No. 3,975,195 and Ser. No. 837,591, filed June 30, 1969, now U.S. Pat. No. 4,013,462 describe layered and binder-type migration imaging systems suitable for use in the present invention in great detail, and all the disclosure therein, and especially the disclosure relating to such imaging processes, imaging members and materials suitable for use in the migration imaging members used therein, is hereby incorporated by reference in the present specification.

The materials suitable for use as substrates 11, softenable layers 13, and migration marking materials 14, are typically the same materials disclosed in the aforementioned copending applications which are incorporated by reference herein. The substrate 11 may be opaque, translucent, transparent, electrically insulating, electrically conductive, or semi-conductive. In still other embodiments, the substrate may itself comprise one or more layers of photoconductive material, thereby making the substrate operative in some of the latent imaging methods described herein, i.e. especially in the charge-expose methods. The substrate and the entire migration imaging member which it supports may be in any suitable form including a web, foil, laminate or the like, strip, sheet, coil, cylinder, drum, endless belt, endless mobius strip, circular disk or other shape. The present invention is particularly suitable for use in any of these configurations.

Where the substrate is electrically conductive, it may comprise any suitable electrically conductive material. Typical conductive substrates include copper, brass, aluminum, steel, cadmium, silver, and gold.

If desired, the conductive substrate may be coated on an insulator such as certain papers, glass or a plastic. One example of this type of substrate comprises NESA glass, which is a partially transparent tin oxide coated glass available from Pittsburgh Plate Glass Co. Another typical substrate comprises aluminized Mylar which is made up of a Mylar polyester film of the E. I. duPont de Nemours Co., Inc. having a thin semi-transparent aluminum coating. Another typical substrate comprises Mylar coated with copper or copper iodide. Such electrically conductive substrate, or the conductive portion thereof, will typically have electrical resistivities in the range of $10^{-8}$ to $10^{-2}$ ohm-cm., although substrate materials having even greater resistivities will perform satisfactorily in various embodiments hereof.

Migration imaging members, plates, or films having electrically insulating substrates may also be used, for example by charging while the insulating substrate is in contact with a grounded conductive member. Alternatively other methods, such as those known in the art of xerography, for charging plates having insulating backings may be applied. For example, the imaging member of FIG. 1 may be moved between two corona charging devices and the surfaces thereof charged to potentials of opposite polarity to cause the desired charging to be effected. Such electrically insulating substrates may comprise any suitable material, including Teflon, polytetrafluoroethylene available from duPont; Mylar, polyester resin available from duPont; polyamide films; plastic coated papers; polyethylene; and glass. The electrically insulating substrate materials will typically have resistivities of not less than about $10^{12}$ ohm-cm., and resistivities preferably not less than about $10^{14}$ ohm-cm. However, materials having lower resistivities will perform satisfactorily in various embodiments hereof.

The softenable layer 12 may comprise any suitable softenable material which is substantially electrically insulating during the imaging and developing cycle. For example, such substantially insulating softenable materials will typically have resistivities not less than about $10^{10}$ ohm-cm., and preferably have resistivities of not less than about $10^{12}$ ohm-cm. However, in various embodiments of the inventive imaging system, softenable materials with even lower resistivities will perform satisfactorily, for example, in embodiments where faster processing or more continuous electrical latent imaging techniques are used. Typical materials include Staybelite Ester 10, a partially hydrogenated rosin ester, Foral Ester, a hydrogenated rosin triester, and Neolyne 23, an alkyd resin, all from Hercules Powder Co.; SR 82, SR 84, silicone resins, both obtained from General Electric Corporation; Sucrose Benzoate, Eastman Chemical; Velsicol X-37, a polystyrene-olefin copolymer from Velsicol Chemical Corp.; hydrogenated Piccopale 100, a highly branched polyolefin, Piccotex 100, polystyrene-vinyl toluene, Piccolastic A-75, 100 and 125, all polystyrenes, Piccodiene 2215, a polystyrene-olefin copolymer, all from Pennsylvania Industrial Chemical Co.; Araldite 6060 and 6071, epoxy resins of Ciba; R5061A, a phenylmethyl silicone resin, from Dow Corning; Epon 1001, a bisphenol A-epichlohydrin epoxy resin, from Shell Chemical Corp.; and PS-2, PS-3, both polystyrenes, and ET-693, a phenolformaldehyde resin, from Dow Chemical; and 96-A, a custom synthesized copolymer of styrene and hexylmethacrylate; paraffins and waxes; and any other material which is typically substantially electrically insulating, and softenable by any suitable means when used in the advantageous system of the present invention.

The above group of materials is not intended to be limiting, but merely illustrative of materials suitable for the softenable layers. The softenable material may also be electrically photosensitive, photoconductive, photosensitively inert, substantially electrically insulating, more semiconductive or electrically conductive, or have other desired properties depending upon its specific use in various other embodiments. For example, photoconductive softenable materials are fully described in copending application Ser. No. 837,592, filed June 30, 1969.

Softenable layers are preferably of thicknesses in a range between about ½ micron and about 16 microns, and softenable layers of thicknesses between about 1 and about 4 microns provide optimum imaging results, with thicker layers generally requiring greater charging potentials. In some embodiments the material comprising the softenable layer may itself possess sufficient integrity so that the softenable layer containing or supporting the marking material may be self-supporting. Such self-supporting softenable layers may be brought into contact with a suitable substrate before or during the imaging process.

"Softenable" as used herein is intended to mean any material which can be rendered more permeable thereby enabling particles to migrate through its bulk. Conventionally, changing the permeability of such material or reducing its resistance to migration of migration marking material, is accomplished by heat or solvent softening.

In various embodiments of the migration imaging members of the present invention, the migration marking material 13 may be electrically photosensitive, photoconductive, photosensitively inert, magnetic, electrically conductive, electrically insulating, or possess any other desired physical property and still be suitable for use in the present migration imaging system. In the advantageous system of the present invention, the migration marking material is also agglomerable material, and the term "agglomerable" and its variant forms herein refers to any material capable of agglomerating, flocculating or clustering and fusing with other particles or portions of the same material when processed in accordance with the present invention.

Materials particularly preferred as agglomerable migration marking materials because of their ability to function as both migration materials and agglomerable materials, include electrically photosensitive materials such as materials comprising selenium, including amorphous selenium, crystalline selenium, selenium-tellurium alloys, arsenic triselenide; and tellurium, sulfur, and others. Other agglomerable migration marking materials which are not necessarily electrically photosensitive materials include gallium, cobalt tricarbonyl; thermoplastics or dyed thermoplastics such as polyoctyl acrylate, polylauryl methacrylate; dyed waxes; dyed paraffins and others. Such materials may be dyed with any suitable material, such as phthalocyanine dyes, fluorescein dyes, or any other dye colorant; a whole host of materials suitable for use as such dyes is set forth in U.S. Pat. No. 3,384,488. In addition, the migration marking particles may comprise a particle matrix comprising an agglomerable material which includes smaller pigment particles. For example, the thermoplastic materials listed above are particularly suitable for such large particle matrices, while any suitable pigment such as zinc oxide, titanium dioxide, lead oxide, phthalocyanine pigments, or any other suitable marking pigment may be used as the pigment particles in the agglomerable migration material matrix. It has been found that the agglomerable migration materials of the present invention preferably have low glass transition temperatures so that they may agglomerate, fuse and coalesce more readily than any effects of the process steps on the materials comprising the softenable layer in the advantageous system of the present invention become noticeable. Where the preferred charge-expose mode of latent imaging is used, such materials also preferably have high absorption coefficients in the visible spectral ranges of the activating electromagnetic radiation.

These agglomerable migration marking materials are contained in the softenable layer in fracturable layers or in dispersed particulate form in such particle sizes and particle spacing conditions that when the softenable layer is softened by any suitable means, such as by heating or by contacting with solvent vapors, and the member is further heated, and that the particles or adjacent portions of the migration marking materials are capable of agglomerating or flocculating together and fusing into a single mass. The agglomerable mass of marking material typically has a lesser total cross-sectional area (in the plane of the surface of the imaging member) than the total cross-sectional area of the material as originally dispersed, and this decrease in area gives lower background density thereby enhancing the contrast in images treated by the advantageous process of the present invention. As disclosed in the incorporated disclosures, particles of the migration marking material suitable for use in the present invention are preferably of average size not greater than about 2 microns. Submicron particles give an even more staisfactory result, with an optimum range of particle size comprising particles of average size not greater than about 0.7 microns. When the migration marking material is arranged in a fracturable layer contiguous the surface of the softenable material spaced apart from the substrate, such fracturable layers are preferably of thicknesses in the range between about 0.01 to about 2.0 microns, although fracturable layers of thicknesses of about 5 microns have been found to give good results in various embodiments.

Where portions of such agglomerable migration marking materials or particles are to be processed by the inventive system (in either image or background or migrated or unmigrated areas) to cause agglomeration and/or fusing, it is preferable that such particles or portions of the agglomerable material have particle-to-particle spacings of not greater than about one-half micron, although in some embodiments, layer particle-to-particle spacings are suitable. Such particle-to-particle spacings facilitate the agglomeration and flocculation of the marking materials.

Where the migration marking material comprises electrically photosensitive material, it may comprise any suitable inorganic or organic electrically photosensitive material. In addition to the preferred agglomerable marking materials already listed above other electrically photosensitive materials may include photoconductive materials such as antimony or bismuth, cadmium sulfide, zinc oxide, cadmium sulfoselenide, and many others. U.S. Pat. No. 3,121,006 to Middleton et al admirably sets forth a whole host of typical inorganic photoconductive pigments. Typical organic photoconductors include: Watchung Red B, a barium salt of 1-(4'-methyl-5'-chloro-azobenzene-2'-sulfonic acid)-2-hydrohydroxy-3-napthoic acid, C.I. No. 15865, available from duPont; Indofast double scarlet toner, a Pyranthrone-type pigment available from Harmon Colors; quindo magenta RV-6803, a quinacridone-type pigment available from Harmon Colors; Cyan Blue; GTNF the beta form of copper phthalocyanine, C.I. No. 74160, available from Collway Colors; Monolite Fast Blue GS, the alpha form of metal-free phthalocyanine, C.I. No. 74100, available from Arnold Hoffman Co.; Diane Blue, 3,3'-methoxy-4,4'-diphenyl-bis(1" azo-2" hydroxy-3"-naphthanilide), C.I. No. 21180, available from Harmon Colors; and Algol G.C., 1,2,5,6-di(D,D'-diphenyl)-thiazole-anthraquinone, C.I. No. 67300, available from General Dyestuffs. The above list of materials is illustrative of some typical electrically photosensitive materials, and should not be taken as a complete listing of such materials.

In other embodiments of the invention the electrically photosensitive material may be replaced with migration marking materials which are not necessarily photosensitive. This material is also typically in particulate form (usually submicron in size) and may be electrically conductive or insulating, or have any other desired properties. Typical such materials comprise carbon black, garnet, iron oxide and other insoluble pigments.

"Fracturable" layer or material as used herein, means any layer or material which is capable of breaking up during development, thereby permitting portions of said layer to migrate toward the substrate or to be otherwise removed. The fracturable layer may be particulate, semi-continuous, microscopically discontinuous or continuous in various embodiments of the migration imaging members.

The overcoating of photosensitive material, or any other migration marking material, which is typically particulate, may be referred to as a "fracturable" layer or material. As noted above, fracturable layer as used herein, refers to any migration layer and specifically the migration layer forms disclosed herein and those layers comprising discrete particles and those comprising apparently more mechanically continuous layers with a microscopic network of lines of mechanical weakness or which are otherwise fracturable and not completely mechanically coherent in the process hereof, which in the imaging member configurations hereof and their equivalents; in response to electrical charging, imagewise exposure to activating radiation and developing are caused to selectively deposit in image configuration on a substrate. Such fracturable layers are typically contiguous the upper surface of the softenable layer and may be coated onto, or slightly, partially, or substantially embedded in the softenable material at the surface of the softenable layer.

The fracturable layer for the layered configuration of FIG. 1A may be formed by any suitable method. Typical methods include vacuum evaporation such as disclosed in U.S. Patent application Ser. No. 423,167, filed Jan. 4, 1965, now abandoned, in application Ser. No. 813,345, filed Apr. 3, 1969 now abandoned; and U.S. Pat. No. 3,598,644 where a fracturable microscopically discontinuous layer of submicron size selenium is formed on a softenable layer. The particulate layer may be formed by other methods such as by cascading or dusting the migration marking material onto or into the softenable material as shown in U.S. Pat. No. 3,520,681. When the binder structure is used, the methods set forth in U.S. Pat. No. 3,121,006, as well as copending application Ser. No. 837,591, may be used to form the binder structure.

Figure 2:
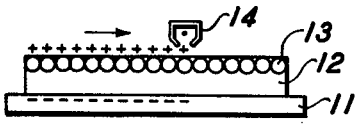
FIG. 2 is a partially schematic, cross-sectional view of the step of electrically charging the imaging member illustrated in FIG. 1A.

Migration imaging members as described herein may be migration imaged by steps including providing the imaging member, applying an imagewise migration force to the migration marking material of said member, and developing the member to allow an imagewise migration of the marking material in depth in the softenable layer toward the substrate. The imagewise migration force applied to the migration marking material is often some sort of electrical latent image. Such electrical or electrostatic latent images may be provided by any suitable means, as disclosed in the incorporated disclosures. For example, where the imaging member comprises electrically photosensitive materials (photosensitive marking material, softenable material, or substrate material) and the optimum charge-expose mode is used to provide an electrical latent image, the uniform electrical charging step as shown in FIG. 2 may be accomplished by any suitable means, such as a corona charging device 14 which passes adjacent the upper surface of the imaging plate and substantially uniformly deposits charge on the surface of the imaging member as it passes over its surface. Typical corona charging methods and devices are described by Walkup in U.S. Pat. No. 2,777,957. Other methods of forming an electrical latent image on the imaging member include directly forming an electrical image by corona charging through a stencil as shown in copending application Ser. No. 483,675, filed on Aug. 30, 1965, or forming a latent image directly through the use of shaped electrodes or a pin matrix. Although these latter methods (for directly forming electrical latent images) may typically be used to image any of the imaging members described herein, they are particularly suited to the latent imaging of migration imaging members which do not comprise electrically photosensitive materials and which are therefore typically not suitable for latent imaging by the charge-expose mode.

The charging potentials required for imaging are generally in the range of those used in copending applications Ser. Nos. 837,780 and 837,591, mentioned above. For positive polarities, a voltage range from about 100 to 300 volts has been found to yield particularly good results. When using voltages of negative polarity, optimum results are obtained when the voltage is from about 25 to 150 volts.

Where either positive or negative charging is used in the charge-expose latent imaging mode on a layered structure imaging member, the electrically photosensitive material in the areas more exposed to radiation typically migrates when developed in a solvent vapor, while the areas less exposed or unexposed to radiation are typically unaffected until the second or heating step of the inventive process. This process typically results in an image having negative image sense vis-a-vis the original being formed. If the positive polarity exceeds about 300 volts, then upon development in a solvent vapor, the migration of the electrically photosensitive material occurs in areas less exposed or unexposed to radiation, and a positive sense image (vis-a-vis the original image) is formed.

Figure 3:
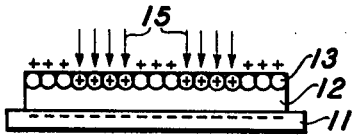
FIG. 3 is a partially schematic, cross-sectional view of the step of imagewise exposing the member charged in FIG. 2, to activating electromagnetic radiation.

After uniformly electrically charging, the imaging member is imagewise exposed to a source of activating electromagentic radiation 15, as shown in FIG. 3. In the areas exposed to radiation, it is believed that hole-electron pairs are generated in the electrically photosensitive particles or material by the action of the incident radiation, while the unexposed areas remain unchanged.

The term "electrical latent image" is used to describe the latent image in the advantageous system of the present invention and that term and the several variant forms thereof used herein include the images formed by the charge-expose mode, which images cannot readily be detected by standard electrometric techniques as an electrostatic latent image for example of the type found in xerography, so that no readily detectable or at best a very small change in the electrostatic potential is found after exposure (when using preferred exposure levels); and include electrostatic latent images of a type similar to those found in xerography which are typically readily measurable by standard electrometers, that is electrostatic latent images showing surface potentials typically reading at least about 5 to 10 volts.

Figure 4:
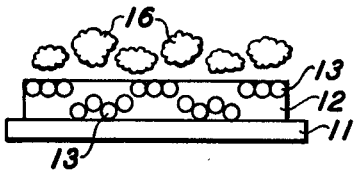
FIG. 4 is a partially schematic, cross-sectional view of developing the latently imaged member with a solvent vapor.

Following the imagewise exposure to activating radiation, the imaging member is then developed as shown in FIG. 4 by contacting with a solvent vapor 16, which is capable of at least softening the softenable material. The exposure to the solvent vapor is usually for a short time such as from about one second or less up to as long as 30 seconds or more. When the imaging member is exposed to the vapor, the electrically photosensitive particles which have been previously exposed to activating radiation typically migrate in depth in the softenable layer as it is softened by the vapor, and deposit at or near the substrate in image configuration as shown in FIG. 4. The areas of the fracturable layer which have not been exposed to radiation typically do not migrate, and remain substantially intact in the softenable layer 12. During the initial stages of the vapor development step (approximately one-tenth second) the electrical fields on all areas of the plate are believed to be substantially dissipated, as illustrated by a comparison of FIGS. 3 and 4 of the drawing. At this point, an image is formed which comprises migrated marking particles in image configuration located at or near the substrate, while the marking particles which have not migrated remain substantially intact within the softenable layer 12. This image is a high quality image, however, the presence of the unmigrated marking material in the background areas makes the migration image quite difficult to view by conventional projection techniques, such as a transparency slide projector.

In general, a few seconds of exposure to, or contact with, the solvent vapor is sufficient to soften the softenable material. The softenable material or layer is softened to a condition where the resistance of said layer to migration of the migration marking material is decreased thereby allowing selective imagewise migration of the marking material in depth in the softenable material towards the substrate. Any suitable solvent and the vapors thereof may be used to develop the imaging member. Typical developing solvents include Freon TMC, available from duPont; trichloroethylene, chloroform, ethyl ether, xylene, dioxane, benzene, toluene, cyclohexane, 1,1,1-trichloroethylene, pentane, n-heptane, Odorless Solvent 3440 (Sohio), Freon 113, available from duPont; m-xylene, carbon tetrachloride, thiophene, diphenyl ether, p-cymene, cis-2,2-dichloroethylene, nitromethane, N,N-dimethyl formide, ethanol, ethyl acetate, methyl ethyl ketone, ethylene dichloride, methylene chloride, 1,1-dichloroethylene, trans 1,2-dichloroethylene, and super naphtholite (Buffalo Solvents and Chemicals).

In exposing to the solvent vapor, a sample of the film or imaging member may simply be held between a pair of tweezers and placed for a few seconds in the vapors contained above a small amount of liquid solvent developer contained in a bottle. If greater control is desired, a graduated cylinder such as a 2 inch diameter 1,000 cc. graduate is used, and partially filled with liquid developer. The sample to be developed is then suspended for a few seconds at a predetermined point, such as the 500 cc. mark, while the graduate contains about 200 cc. of liquid developer. By using the above technique, images having a consistently high quality are easily prepared. If desired, the vapor can be brought to the imaging member through the use of fans, blowers, or the like.

In another embodiment, instead of exposing the latently imaged member to a single vapor, a combination of two separate vapor treatments may be performed. For example, an initial treatment in vapors of Freon 113 for several seconds results in the formation of a migration image. This is followed by a second vapor treatment for example in 1,1,1-trichloroethylene for several seconds, and provides an effective way of development which allows for the use of a lower initial charging potential. The use of 1,1,1-trichloroethylene vapor alone, requires a charging potential in the neighborhood of about at least 100 volts positive potential, while the double treatment with Freon 113 and 1,1,1-trichloroethylene allows initial charging voltage to be reduced to about 75 volts. If desired, mixtures of various developers may also be used. For example, the vapors of a liquid mixture of up to 50% by volume of Freon 113 and methylene chloride provides a satisfactory developer.

This embodiment wherein two separate vapor treatment steps are performed on the imaging member also has the advantage of allowing the migration development to occur in response to the first vapor treatment, while the second brief treatment with vapors aids the agglomeration of the agglomerable migration marking materials in the unmigrated areas of the imaged member. This system typically reduces the probability of any undesired agglomeration among the imagewise migrated marking materials.

Figure 5:
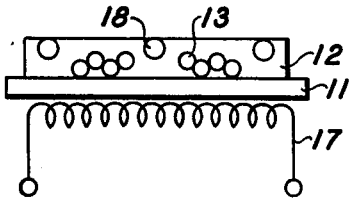
FIG. 5 is a partially schematic, cross-sectional view of one mode of heating the vapor developed imaging member of FIG. 4 to achieve the advantageous results of the present invention.

The application of a heating step following vapor development results in the selective flocculation or agglomeration and possible fusion of the electrically photosensitive particles or other migration marking material in the unmigrated areas, or alternately in the migrated areas. The heating is sufficient to allow for the softening of the softenable material 12 and agglomerable materials 13 to a degree which will allow the migration marking material to flocculate or agglomerate and fuse. Any temperature which will result in this effect is suitable. Typical temperatures for the softenable materials mentioned above are from about 60° to 130° C., but temperatures outside this range may be used depending upon the materials employed in the imaging member structure. The temperature and supporting substrate are usually selected so as to prevent warping or buckling of the substrate during heating. The time for heating is not particularly critical. Generally about 1 to 10 seconds of heating is sufficient to cause agglomeration, flocculation, and fusing. The heating may be carried out by any convenient means such as a heating coil 17 shown in FIG. 5, a hot plate, forced hot air, etc. The heating step of the instant process is believed to occur in the absence of macroscopic electric fields, and inasmuch as particle migration has typically already taken place and vapor development treatment may have dissipated the electrical charges on the member, the heating step may be carried out in the absence of dark room conditions.

The agglomeration and flocculation, which is typically accompanied by fusion of the individual particles of the migration marking material selectively reduces the density of background or image areas of the imaged member. Such areas are typically reduced to zero, i.e., they are not visible by the naked eye. The reduction in optical density is due to the substantial reduction in the cross-sectional area of the migration marking material in the plane of the imaging film or member. For example, the fused agglomerates of marking material are typically up to 5 to 10 times larger than the original agglomerable marking particles (although agglomerate size is typically limited within the thickness of the softenable layer), and the number of such layer particles per unit area of film is greatly reduced in comparison to the particle number density in non-agglomerated areas, so that the total cross-sectional areas of such particles is correspondingly reduced. Images produced by the inventive system are readily visible as high resolution, high contrast density images when viewed by conventional projection techniques.

In a further embodiment of this invention, the migration image may be formed by first heating the plate or film supporting an electrical latent image. The background is then reduced by subjecting the plate to a vapor treatment and heating again. For example, an about 2 micron layer of Staybelite Ester, a hydrogenated rosin ester available from Hercules Powder Co., overcoated with an about 0.5 micron layer of particulate vitreous selenium, supported on an about 0.5 mil Mylar polyester film is imaged and developed as follows: The imaging member is charged to a negative potential of about 200 volts and then developed by heating to a temperature of about 100° C. for about 10 seconds to form a migration image. The member is then exposed to vapors of 1,1,1-trichloroethylene for about 45 seconds, and then heated again to about 100° C. for about 10 seconds which results in a clearing or reduction of the background to near zero.

The heating development temperatures and times to form the migration image are substantially the same as those for the final heating step already described. When using heat to form the migration image, a vapor treatment precedes the final heating step so that the softenable layer is sufficiently softened. The parameters for the vapor treatment are substantially those described above for the two step vapor-heat development method. If desired, once a heat-migration image has been formed, the subsequent vapor and heating steps may be carried out simultaneously. Once the migration image has been formed, whether it be by heat or vapor, any further treatment may be carried out in room light or the absence of dark room conditions inasmuch as the image has already been formed, and the imaging member is believed to be substantially electrically discharged.

Although solvent vapor development and heat development have been described in detail above, any suitable means may be used to migration develop the migration imaging member by reducing or decreasing the resistance of the material comprising the softenable layer to migration of migration marking material through the softenable layer whereby the marking material migrates in imagewise configuration in depth in the softenable material toward the substrate. Reducing the resistance of the softenable material typically comprises changing its permeability by reducing its viscosity by softening, for example, by heating or contacting with solvent or solvent vapors, or even by dissolving the softenable material.

In a still further embodiment of this invention the migration imaging system may be performed on an imaging member comprising two different softenable materials, for example, a member similar to that illustrated in FIG. 1C, however, the migration marking material 13 is initially located in the upper layer of softenable material 12*a;* the two layers of softenable material 12 and 12*a,* may comprise different material with different softenable characteristics so that one of the two layers of softenable material softens under development conditions substantially different from the other softenable layer. For example, the lower softenable layer 12 may comprise a more viscous material, or a material whose softening temperature is greater than that of the material in the upper softenable layer 12*a,* so that when migration marking material 13 is migrated into the underlying softenable material 12, and the advantageous vapor exposure and heating steps of the present invention are performed on such a member, the agglomeration and fusing effects of the advantageous system of the present invention occur almost exclusively among the migration marking material particles which remain located in the upper softenable material layer 12*a.* In this way, the migration marking material which is migrated into the lower softenable layer 12 is preserved in its original particulate form and size, which typically produces a dense migration image in the lower softenable layer 12. Where the migration marking material which is migrated into the lower softenable layer 12 is not migrated substantially to the substrate 11, this imaged member may again be charged, exposed, and developed to migrate the imagewise migration material to the substrate in order to further enhance the density of the migration image, which has been made quite visible by the advantageous agglomeration effects already described above.

Similarly, the upper softenable layer 12*a* may be fabricated to comprise the higher viscosity or higher softening point materials so that upon the application of solvent vapors suitable for slightly softening the underlying softenable material in layer 12 and heating the imaging member, after the initial migration image has been migrated into the lower softenable layer 12, those migrated particles may be caused to agglomerate and fuse in their positions in the lower softenable layer 12, while the unmigrated marking materials in the upper, more stable softenable material of layer 12*a* are maintained in substantially their original condition, thereby creating a dense image comprising the unmigrated marking materials contained in softenable layer 12*a.* This latter embodiment, for example, may be provided by providing an imaging member such as the one described in conjunction with FIG. 1A, charging, exposing, and developing a migration image by vapor or heat softening development techniques, as described already herein, then hardening the surface of the softenable layer containing the migration marking material by exposing said surface to ultraviolet hardening radiation, and thereafter treating with solvent vapors and/or heat to cause the advantageous agglomeration effect in the particles which have migrated toward the substrate and which are contained in the portions of the softenable layer which are not affected by the hardening radiation. Such ultraviolet radiation hardening effects are described, for example, in copending application Ser. No. 6,862, filed Jan. 29, 1970.

In still a further embodiment of the inventive system, imaging members such as the one illustrated in FIG. 1C are used. Sucm imaging members include additional overlayer 12*a,* which in various embodiments may be an additional overlayer of softenable material such as that used in the usual softenable layer 12, or alternatively, the overlayer may comprise other material which are typically harder or more viscous than the softenable materials typically used in layer 12, or in still other embodiments the advantageous overlayer may comprise an overlayer of a gelatin composition. Such overlayered migration imaging members are particularly advantageous for use in the inventive system because the overlayer typically inhibits agglomeration and/or fusion of the agglomerable migration marking materials which are contiguous the overlayer-softenable layer interface, thereby typically allowing only those agglomerable migration material which have migrated away from the interface to agglomerate and/or fuse in the advantageous system of the present invention. In this way, undesired agglomeration of the marking materials in the desired image areas is reduced or minimized by the presence of the advantageous overlayer 12*a.* Such overlayered migration imaging members are more fully described in copending application Ser. No. 172, filed Jan. 2, 1970, now abandoned, the entire disclosure of which is hereby incorporated by reference in the present specification.

All of the above embodiments of the migration imaging system suitable for use in the present invention make it clear that an imaged migration-type member may be provided by a variety of means, for processing in the advantageous background reducing system of the present invention. Indeed any suitable means of providing such an imaged member may be used in the inventive system.

The following examples further specifically define the present invention wherein an imaged migration-type imaging member is provided or produced and the background areas thereof are reduced by steps causing the marking material in said areas to agglomerate and/or fuse. The parts and percentages herein are by weight unless otherwise indicated. The examples below are intended to illustrate various preferred embodiments of the novel imaging system.

EXAMPLE I

An imaging member or film such as that illustrated in FIG. 1 is prepared by first making a mixture of about 5% by weight of Staybelite Ester 10 (a 50% hydrogenated glycerol rosin ester of the Hercules Powder Co.), dissolved in a solution of about 20% cyclohexanone and about 75% toluene. Using a gravure roller, the mixture is roll coated onto an about 3 mil thick Mylar polyester film (E. I. duPont de Nemours Co., Inc.) having a thin, semi-transparent aluminum coating. The prepared coating is applied so that when air dried for about 2 hours, to allow evaporation of the cyclohexanone and toluene solvent, an imaging member comprising an about two micron layer of Staybelite Ester is formed on the aluminized Mylar substrate. A thin layer of particulate vitreous selenium approximately 0.5 microns in thickness is then deposited onto the surface of the softenable Staybelite layer by inert gas deposition utilizing the process set forth in application Ser. No. 423,167, filed on Jan. 4, 1965, now abandoned, application Ser. No. 813,345, filed Apr. 3, 1969, now abandoned, and U.S. Pat. No. 3,598,644.

A sample of this imaging member or film is imaged and developed in the following manner: The film sample is charged under dark room conditions to a positive surface potential of about 100 volts by a corona charging device such as that described in U.S. Pat. No. 2,588,699. The film is then imagewise exposed to an optical image of activating electromagentic radiation from a tungsten lamp, with the energy in the illuminated areas of about 5 foot-candle-seconds. The film is then developed, while still maintaining dark room conditions, by immersing in vapors of 1,1,1-trichloroethylene by holding the film with a pair of tweezers and placing it into the mouth of an about two liter bottle containing about 100 cc.'s of liquid 1,1,1-trichloroethylene in the bottom. The film is held above the liquid developer and exposed to the vapors above the liquid for about 3 seconds and then removed from the bottle. When the film is examined under a microscope, it is found that a migration image is formed with the image appearing as a partial dispersion of the selenium particles in depth in the areas exposed to light during the imagewise exposure step. The image results from the migration of the selenium particles to or near the substrate. The selenium particles in the unexposed areas remain substantially intact. Following the vapor development, the image remains fixed within the softenable layer with the film substantially electrically discharged in both the light exposed and unexposed areas.

The vapor developed film is then heated by placing the film for about 3 seconds on a hot plate maintained at a temperature of about 90° C. At the end of this heating step the film is then viewed in a conventional slide projector and exhibits a reduced background density near zero, with an image density of about 0.9+. When viewed under a microscope, the selenium particles in the previously unexposed areas are observed to have agglomerated and fused due to the heating, and now form relatively large spheres. The selenium particles in the previously light exposed areas, which have migrated in image configuration during the vapor development, appear to remain about their original size, substantially uneffected by the heating step.

EXAMPLE II

A sample of the migration imaging member prepared by the method described in Example I is imaged and developed as follows. The film is charged under dark room conditions to a positive surface potential of about 50 volts by a corona charging device such as that shown in U.S. Pat. No. 2,588,699. The film is then imagewise exposed to about 10 foot-candle-seconds of light from a tungsten light source. While still maintaining dark room conditions, the film is vapor developed using the technique in Example I except that two separate exposures to vapor are used. The film is first exposed to vapors of Freon 113 for about 2 seconds causing a migration of the selenium particles in the light struck areas. With the room lights on, the film is then exposed to 1,1,1-trichloroethylene vapors for about 3 seconds. The film is then placed on a hot plate and heated for about 2 seconds at about 95° C. When viewed in a slide projector, this film exhibits substantially no background due to the agglomeration and fusion of the selenium particles caused by the heat in the areas which have not been struck by radiation and did not migrate toward the base.

EXAMPLE III

An imaging member or film is formed by the method of Example I in which the Staybelite Ester is replaced with an about 5% mixture of a custom synthesized copolymer of styrene and hexylmethacrylate, dissolved in toluene. The resultant member comprises a thin particulate vitreous selenium layer approximately 0.5 microns in thickness deposited in the upper surface of the softenable layer which is contained on an about 3 mil aluminized Mylar substrate.

A sample of the film is developed and imaged in the following manner: The film is charged under dark room conditions to a positive potential of about 200 volts with a corona charging device such as that described in U.S. Pat. No. 2,588,699. The film is imagewise exposed to an optical image of radiation from a tungsten lamp with energy in illuminated areas of about 5 foot-candle-seconds. A two inch diameter, 1000 cc. graduated cylinder is then filled with about 200 cc.'s of an about 50% mixture of Freon 113, trichlorotrifluoroethane available from Dupont, and methylene chloride. While still under dark room conditions, the sample film is then suspended for about 4 seconds at the 500 cc. mark of the graduate. When examined under a microscope, the film exhibits an image of migrated selenium particles formed in the areas struck by the illumination, while the areas which have not been exposed to light retain the selenium particles in the upper surface of the softenable layer, substantially intact.

The vapor developed film is placed for about 4 seconds on a heated hot plate maintained at about 90° C. The film is then removed from the hot plate and viewed in a slide projector. The background density of the imaged film is substantially zero, while it shows high density in the image areas. When examined under a microscope, the film shows small areas in which agglomeration and fusion of the selenium particles has occurred in the unmigrated areas not exposed to light in response to the heating step. When viewed with the naked eye, the background (areas which were not exposed to light) appears substantially transparent with only the selenium particles in the migrated image areas being visible.

EXAMPLE IV

An imaging member or film is prepared according to the method set forth in Example I in which the Staybelite Ester is replaced with an about 5% mixture of HP-100, a highly branched polyolefin, dissolved in toluene, with the final imaging member comprising a thin layer, 0.5 microns thick, of particulate vitreous selenium contained in the upper surface of the HP-100 softenable layer on aluminized Mylar.

A sample of the film is imaged and developed in the following manner: The film is charged under dark room conditions to a positive potential of about 200 volts with a corona charging device such as that described in U.S. Pat. No. 2,588,699. The film is imagewise exposed to an optical image of radiation from a tungsten lamp with energy in the illuminated areas of about 15 foot-candle-seconds. Using the graduated cylinder of Example III, the film is held for about 3 seconds at the 500 cc. mark of the graduate above the liquid developer, and then removed from the graduate. The film is then placed for about 3 seconds on a heated hot plate maintained at about 90° C. When viewed with the naked eye, the film shows an image of selenium particles clearly visible with the remainder of the film appearing substantially transparent in the areas unexposed to light. When viewed under a microscope, areas of agglomeration and fusion of the selenium particles in the areas previously unexposed to light are clearly visible.

The size range for the particulate vitreous selenium used in Examples I–IV is from about 0.03 to 0.7 microns in diameter, with most of the particles falling within a size range of from about 0.03 to 0.5 microns. The increase in size (due to agglomeration and fusion during heating) in the areas which have not migrated, is up to about 5 times larger than the average size of the original selenium particles.

EXAMPLE V

An imaging member is formed by the method of Example I wherein the softenable layer is provided by coating a solution of about 5 percent of a custom synthesized copolymer of styrene and hexylmethacrylate dissolved in toluene onto an about 3 mil aluminized Mylar substrate. The softenable layer has a thin particulate layer of an about 90 percent selenium, 10 percent tellurium alloy, vacuum evaporated thereon which is about 0.5 microns thick and deposited in the upper surface of the softenable layer.

A sample of this imaging member is imaged by charging under dark room conditions to a potential of about +100 volts and exposing to an optical image with exposure in the illuminated areas of about 10 foot-candle-seconds. This latently imaged member is then solvent vapor softened developed by suspending it for about 4 seconds at about the 500 cc. mark of a graduate containing about 200 cc. of an about 50 percent mixture of Freon 113 and methyl chloride. Examined under a microscope the film exhibits an image of migrated selenium-tellurium particles formed in the exposed areas of the areas which retain the selenium-tellurium particles in the upper surface of the softenable layer and substantially their original condition.

The migration developed film is then placed for about 3 seconds on a heated hot plate maintained at about 100° C. The film is then removed from the plate and viewed in a slide projector. The background density of the imaged film is very low, while it shows high density in the migrated image areas. When examined under a microscope, the film shows small areas in which agglomeration and fusion of the selenium-tellurium particles has occurred in the unmigrated or unexposed areas in response to the heating step in the present invention. The background areas appear substantially transparent with only the selenium-tellurium particles in the migrated areas being visible.

EXAMPLE VI

An imaging member or film is formed wherein an about 3 mil aluminized Mylar substrate is coated with a solution of about 5 percent of a mixture of custom synthesized copolymer of styrene and hexylmethacrylate dissolved in toluene to form a softenable layer on the substrate. Submicron particles of amorphous sulfur are then cascaded across the free surface of the softenable layer, and the softenable material is slightly softened to capture a layer of the sulfur particles at the surface of the softenable layer.

A sample of the film is imaged by charging under dark room conditions through a mask to an imagewise surface potential of about 200 volts using a corona charging device which deposits charges through a steel stencil in imagewise configuration. The latently imaged member is developed by suspending it in a 1,000 cc. graduated cylinder containing about 200 cc. of Freon 113 and methyl chloride developing solvent. When examined under a microscope, the film exhibits an image of migrated sulfur particles formed in the charged areas, while the uncharged areas still contain sulfur particles at the upper surface of the softenable layer in substantially their original condition.

The vapor developed film is placed for about 3 seconds on a heated hot plate maintained at about 100° C. and then removed and viewed in a slide projector. The background density of the imaged film is substantially zero while it shows substantial density in the image areas. When examined under a microscope, the film shows smaller areas in which agglomeration and fusion of the sulfur particles have occurred in the unmigrated areas in response to the heating step in the present invention. To the naked eye, the background areas appear substantially transparent with the sulfur particles in the migrated areas visible in imagewise configuration.

EXAMPLE VII

An imaging member or film is formed wherein an about 3 mil aluminized Mylar substrate is coated with a solution of about 5 percent of a mixture of custom synthesized copolymer of styrene and hexylmethacrylate dissolved in toluene to form a softenable layer of the substrate. Submicron particles of arsenic triselenide about 5 percent by mixture of custom synthesized copolymer of styrene and hexylmethacrylate dissolved in toluene to form an about 3 micron thick softenable layer on the substrate. About 1 micron particles of gallium are then cascaded across the free surface of the softenable layer is slightly softened to capture a layer of gallium particles at the surface of the softenable layer.

A sample of the film is imaged by charging under dark room conditions through a mask to an imagewise surface potential of about 200 volts using a corona charging device which deposits charges through its steel stencil in imagewise configuration. The latently imaged member is developed by suspending it in the vapors over the liquid in a 1,000 cc. graduated cylinder containing about 200 cc. of Freon 113 and methylchloride developing solvent. When examined under a microscope, the film exhibits an image of migrated gallium particles formed in the charged areas, while the uncharged areas still contain the gallium particles at the upper surface of the softenable layer in substantially their original condition.

The vapor developed film is placed for about 5 seconds on a heated hotplate, maintained at about 110° C. and then removed and viewed in a slide projector. The background density of the imaged film is substantially reduced while it shows high density in the imaged areas. When examined under a microscope, the film shows small areas in which agglomeration and fusion of the gallium particles has occurred in the unmigrated areas in response to the heating step in the present invention. To the naked eye, the background areas appear substantially transparent with the gallium particles in the migrated areas visible in imagewise configuration.

EXAMPLE IX

An imaging member or film is formed wherein an about 3 mil aluminized Mylar substrate is coated with a solution of about 5 percent of a mixture of custom synthesized copolymer of styrene and hexylmethacrylate dissolved in toluene to form an about 3 micron thick softenable layer on the substrate. About one micron sized particles of polyoctyl acrylate dyed with phthalocyanine are then cascaded across the free surface of the softenable layer, and the softenable material is slightly softened to capture a layer of the polyoctyl acrylate particles at the surface of the softenable layer.

A sample of the film is imaged by charging under dark room conditions through a mask to an imagewise surface potential of about 200 volts using a corona charging device which deposits charges through a steel stencil in imagewise configuration. The latently imaged member is developed by suspending it in the vapors in an about 1,000 cc. graduated cylinder containing about 200 cc. of Freon 113 and methylchloride developing solvent. When examined under a microscope, the film exhibits an image of migrated, dyed polyoctyl acrylate particles formed in the charged areas, while the uncharged areas still contain the polyoctyl acrylate particles at the upper surface of the softenable layer in substantially their original condition.

The vapor developed film is placed for about 4 seconds on a heated hotplate maintained at about 100° C. and then removed and viewed in a slide projector. The background density of the imaged film is substantially reduced while it shows high density in the imaged areas. When examined under a microscope, the film shows smaller areas in which agglomeration and fusion of the dyed polyoctyl acrylate particles have occurred in the unmigrated areas in response to the heating step in the present invention. To the naked eye, the background areas appear substantially transparent with the dyed polyoctyl acrylate particles in the migrated areas visible in the imagewise configuration.

Although specific components and proportions have been stated in the above description of the preferred embodiments of the novel migration imaging system and system for reducing background in the migration-type images of the present invention, other suitable materials and variations in the various steps in the system as listed herein, may be used with satisfactory results and various degrees of quality. In addition, other materials and steps may be added to those used herein and variations may be made in the process to synergize, enhance or otherwise modify the properties of the invention. For example, various other combinations of agglomerable materials and softenable materials which undergo the inventive image background density reduction may be discovered and used in the system of the present invention, and such mixtures may require somewhat different imaging conditions for preferred results.

Or, in certain applications, it may be useful to completely erase or destroy visible images in migration-type imaging members by the advantageous transparentizing steps of the present invention. This quick and easy method of erasing such images is in itself useful to destroy visible information which a user may not desire to discard in visible form. Furthermore, erased migration-type imaging members such as the ones just described above, typically still contain the image patterns of agglomerates in the erased member, and such normally invisible images may themselves be retrievable by stripping or splitting techniques followed by microscopic observation. For example, such stripping and splitting techniques are described in detail in copending application Ser. No. 784,164, filed Dec. 16, 1968, now U.S. Pat. No. 3,741,757, the entire disclosure of which is hereby incorporated by reference in the present specification. The advantageous stripping or splitting step may also be performed on a visibly imaged member which has either the image or background areas reduced by the advantageous method of the present invention.

It will be understood that various other changes in the details, materials, steps and arrangements of elements which have been herein described and illustrated in order to explain the nature of the invention, will occur to and may be made by those skilled in the art, upon a reading of this disclosure, and such changes are intended to be included within the principle and scope of this invention.

What is claimed is:

1. An imaging method comprising:

providing a member comprising a layer of softenable material and agglomerable material both of which are capable of being softened by at least one of contact by solvent vapors below, heating below or combinations thereof, said agglomerable material distributed in depth in said softenable material in a first image configuration and comprising in addition to said first image pattern of agglomerable material, a complementary background pattern comprising agglomerable material in said softenable material, at least in part spaced apart in depth in said softenable material from said first image pattern, and heating said member simultaneously with or after contacting said member with solvent vapors sufficiently to substantially reduce the effective optical cross-sectional area of the agglomerable material selectively in either said image or said background areas.

2. The method of claim 1 comprising heating said softenable material to a temperature in the range between about 60° C. and about 130° C. whereby said softenable material is softened and said agglomerable material is agglomerated.

3. The method of claim 2 wherein the contact with solvent vapors is of a duration not greater than about 30 seconds.

4. The method of claim 3 wherein said softenable material is selected from the group consisting of resins, waxes and mixtures thereof.

5. The method of claim 1 wherein said softenable layer contacts a supporting substrate.

6. The method of claim 5 wherein the supporting substrate is electrically conductive.

7. The method of claim 5 wherein the supporting substrate and softenable material are substantially optically transparent.

8. The method of claim 1 wherein said agglomerable material comprises particulate material.

9. The method of claim 8 wherein the particulate material comprises electrically photosensitive material.

10. The method of claim 9 wherein the particulate material comprises photoconductive material.

11. The method of claim 10 wherein said photoconductive material comprises vitreous selenium.

12. The method of claim 1 wherein said layer of softenable material is of a thickness in the range between about one-half and about 16 microns.

13. The method of claim 1 wherein said layer of softenable material is of a thickness in the range between about 1 and about 4 microns.

14. The method of claim 8 wherein the agglomerable particulate material in either said image or said background areas comprise agglomerates of said agglomerable material and said agglomerates are about 5 to 10 times larger in size as compared to the particulate material in either said image or said background areas which have not had the effective optical cross-sectional area of the agglomerable material reduced.

15. An imaging method comprising:

(a) providing an imaging member comprising a layer of softenable material which is substantially electrically insulating at least until migration is initiated, said softenable layer containing agglomerable migration marking material, said softenable layer and said agglomerable migration marking material both of which are capable of being softened by at least one of contact by solvent vapors below, heating below or combinations thereof, said softenable material capable of having its resistance to migration marking material decreased sufficiently to allow migration of agglomerable migration marking material in depth in said softenable material, (b) forming an electrical latent image on said member, (c) softening said softenable material to decrease the resistance to migration of the marking material through the softenable material whereby selected portions of the agglomerable material migrate in depth in said softenable layer in image configuration, while the softenable layer and unmigrated portions of the agglomerable migration marking material remain substantially intact, said softening being insufficient to effect the effective optical cross-sectional area of the agglomerable material, and (d) heating said member simultaneously with or after contacting said member with solvent vapors sufficiently to substantially reduce the effective optical cross-sectional area of the agglomerable material selectively in either said image or said background areas.

16. The method of claim 15 wherein the softening step comprises contacting the imaging member with solvent vapors capable of softening said softenable material.

17. The method of claim 16 wherein the softening step (c) and the step (d) including contacting the imaging member to solvent vapors, are performed simultaneously by a single step comprising contacting said imaging member with solvent vapors.

18. The method of claim 15 wherein said softening step comprises heating the imaging member.

19. The method of claim 15 comprising heating said softenable material to a temperature in the range between about 60° C. and about 130° C. whereby said softenable material is softened and said agglomerable material is agglomerated.

20. The method of claim 19 wherein the contact with solvent vapors is of a duration not greater than about 30 seconds.

21. The method of claim 20 wherein said softenable material is selected from the group consisting of resins, waxes and mixtures thereof.

22. The method of claim 15 wherein said softenable layer contacts a supporting substrate.

23. The imaging member of claim 22 wherein the supporting substrate is electrically conductive.

24. The method of claim 22 wherein the supporting substrate and softenable material are substantially optically transparent.

25. The method of claim 15 wherein said agglomerable material comprises particulate material.

26. The method of claim 25 wherein the particulate material comprises electrically photosensitive material.

27. The method of claim 26 wherein the particulate material comprises photoconductive material.

28. The method of claim 27 wherein said particulate photoconductive material comprises vitreous selenium whereby said particulate selenium agglomerates and fuses in the unmigrated areas to form larger particles of selenium.

29. The method of claim 15 wherein said layer of softenable material is of a thickness in the range between about one-half and about 16 microns.

30. The method of claim 15 wherein said layer of softenable material is of a thickness in the range between about 1 and about 4 microns.

31. The method of claim 25 wherein the agglomerable particulate material in either said image or said background areas comprises agglomerates of said agglomerable material, and said agglomerates are about 5 to 10 times larger in size as compared to the agglomerable particulate material in either said image or said background areas which have not had the effective optical cross-sectional area of the agglomerable material reduced.

32. The method of claim 15, wherein the agglomerable material described in (a) is contained in a fracturable layer contiguous the surface of said softenable layer and contacting said softenable layer.

33. The method of claim 32 wherein the imaging member additionally comprises an overlayer of softenable material overlying the fracturable layer contiguous the surface of said softenable layer and contacting said softenable layer.

34. The method of claim 25 wherein the particulate material is dispersed throughout the softenable layer.

35. The method of claim 26 wherein the electrical latent image on said member is formed by steps comprising substantially uniformly electrostatically charging said member, and exposing said member to an image pattern of activating radiation.

36. The method of claim 35 wherein said member is electrostatically charged in the absence of activating radiation.

37. The method of claim 15 wherein the electrical latent image is formed by electrostatically charging said member in image configuration.

38. An imaged member comprising a softenable layer containing agglomerable material in first image configuration and a complementary image configuration comprising larger agglomerates as compared to said agglomerable material in said first image configuration, said complementary image at least in part spaced in part in depth in said softenable layer from said first image configuration.

39. The imaged member of claim 38 wherein said agglomerable material is particulate material and said larger agglomerates of said material are present in a lower particle number density in said complementary image than the particulate agglomerable material in said first image configuration.

40. The imaged member of claim 39 wherein said agglomerates are about 5 to 10 times larger in size as compared to the particles in the first image configuration.

41. The imaged member of claim 39 wherein said particles comprise electrically photosensitive material.

42. The imaged member of claim 41 wherein said particles comprise photoconductive material.

43. The imaged member of claim 42 wherein said photoconductive particles comprise selenium.

44. The imaged member of claim 43 wherein said particles of selenium in said complementary image configuration comprise larger size spherical shaped particles of selenium as compared to the selenium particles in the first image configuration.

45. The imaged member of claim 43 wherein said particles in image configuration are of a particle size in the range between about 0.03 and 0.7 microns in diameter, and said larger particles are of a size not greater than about 5 times the average size of said image particles.

46. The imaged member of claim 38 wherein said softenable layer is of a thickness in the range between about 1 and about 4 microns.

47. A method of image erasure comprising:

providing an imaged member comprising a layer of softenable material containing migrated agglomerable migration marking material in an image configuration, and heating said member simultaneously with or after contacting said member with solvent vapors capable of softening said softenable material whereby the effective optical cross-sectional area of the migrated agglomerable migration marking material in said image configuration is substantially reduced.

48. The method of claim 47 wherein an imaged migration-type imaging member is erased according to claim 47, and said imaging member is split in a plane substantially parallel and between the surfaces of said softenable layer whereby a portion of said softenable layer containing said image configuration is split from the remainder of said imaging member.

49. The method of claim 1 wherein an imaged migration-type imaging member has either the image or background areas selectively reduced by the method of claim 1, and said imaging member is split in a plane substantially parallel and between the surface of said softenable layer whereby a portion of said softenable layer containing either said image or said background configuration is split from the remainder of said imaging member.

50. The method of claim 33 wherein the overlayer of softenable material comprises gelatin.

51. The method of claim 33 wherein the overlayer of softenable material is more viscous as compared to the softenable layer when both layers are exposed to solvent vapors or heat or combinations thereof.

52. The method of claim 4 wherein said waxes comprise parafins.

53. The method of claim 21 wherein the waxes comprise parafins.

54. An imaging method comprising:

providing a member comprising a layer of softenable material and agglomerable material, said softenable material being in a sufficiently softened condition to allow said agglomerable material when softened by at least one of contact by solvent vapors below, heating below or combinations thereof to have its effective optical cross-sectional area reduced, said agglomerable material distributed in depth in said softenable material in first image configuration and comprising in addition to said first image pattern of agglomerable material, a complementary background pattern comprising agglomerable material in said softenable material at least in part spaced apart in depth in said softenable material from said first image pattern; and heating said member and contacting said member with solvent vapors sufficiently to substantially reduce the effective optical cross-sectional area of the agglomerable material selectively in either said image or said background areas.

55. An imaging method comprising:

providing a member comprising a first layer of softenable material and agglomerable material both of which are capable of being softened by at least one of the contact by solvent vapors below, heating below or combinations thereof, said agglomerable material distributed in depth in said first layer of softenable material in a first image configuration and a second layer of softenable material overlying said first layer of softenable material and agglomerable material both of which are capable of being softened by at least one of contact by solvent vapors below, heating below or combinations thereof, said agglomerable material comprising a complementary background pattern to said first image configuration, and heating said member simultaneously with or after contacting said member with vapors sufficiently to substantially reduce the effective optical cross-sectional area of the agglomerable material selectively in either said first image configuration or said complementary background areas.

56. The method of claim 55 wherein the softenable material comprising said first layer of softenable material is more viscous than the softenable material comprising said second layer of softenable material when both layers of softenable material are exposed to solvent vapors or heat or combinations thereof.

57. The method of claim 55 wherein the softenable material comprising said second layer of softenable material is more viscous than the softenable material comprising said first layer of softenable material when both layers of softenable material are exposed to solvent vapors or heat or combinations thereof.

58. An imaging method comprising:

(a) providing an imaging member comprising a first layer of softenable material which is substantially electrically insulating at least until migration in initiated, said first layer of softenable material containing agglomerable migration marking material, said softenable material and said agglomerable material both of which are capable of being softened by at least one of contact by solvent vapors below, heating below or combinations thereof, and a second layer of softenable material both said first and second layers of softenable material capable of being softened to decrease the resistance of both said first and second layers of softenable material to migration of said marking material through both first and second layers of softenable material, (b) forming an electrical latent image on said member, (c) softening said first and second layers of softenable material sufficiently to decrease the resistance to migration of the marking material through the first and second layers of softenable material whereby selected portions of the agglomerable material migrate in depth in said first and second layers of softenable material in image configuration, while the first and second layers of softenable material and unmigrated portions of the agglomerable migration marking material remain substantially intact, said softening being insufficient to effect the effective optical cross-sectional area of the migration marking material, (d) heating said member simultaneously with or after contacting said member with solvent vapors sufficiently to substantially reduce the effective optical cross-sectional area of the agglomerable material selectively in either said image or said background areas.

59. The method of claim 58 wherein the softenable material comprising said first layer of softenable material is more viscous than the softenable material comprising said second layer of softenable material when both layers of softenable material are exposed to solvent vapors or heat or combinations thereof.

60. The method of claim 59 wherein selected portions of the agglomerable migration marking material migrate in depth into said second layer of softenable material and said agglomerable migration marking material in said second layer of softenable material agglomerates thereby reducing the effective optical cross-sectional area of said agglomerable migration marking material.

61. The method of claim 58 wherein the softenable material comprising said second layer of softenable material is more viscous than the softenable material comprising said first layer of softenable material when both layers of softenable material are exposed to solvent vapors or heat or combinations thereof.

62. The method of claim 61 wherein selected portions of the agglomerable migration marking material migrate in depth into said second layer of softenable material, and the portions of the agglomerable material remaining in said first layer of softenable material agglomerates thereby reducing the effective optical cross-sectional area of said agglomerable migration marking material.

* * * * *